US009511298B2

(12) United States Patent
Sgromo et al.

(10) Patent No.: US 9,511,298 B2
(45) Date of Patent: Dec. 6, 2016

(54) WATER SLIDE

(71) Applicant: Bestway Inflatables & Material Corp., Shanghai (CN)

(72) Inventors: Peter A. Sgromo, San Francisco, CA (US); Robert W. Ranftl, Rolling Hills Estates, CA (US)

(73) Assignee: Bestway Inflatables & Material Corp., Shanghai (CN)

( * ) Notice: Subject to any disclaimer, the term of this patent is extended or adjusted under 35 U.S.C. 154(b) by 0 days.

(21) Appl. No.: 14/799,521

(22) Filed: Jul. 14, 2015

(65) Prior Publication Data

US 2016/0136528 A1 May 19, 2016

Related U.S. Application Data

(60) Provisional application No. 62/024,124, filed on Jul. 14, 2014.

(51) Int. Cl.

| | |
|---|---|
| ***A63G 21/18*** | (2006.01) |
| ***A63G 31/12*** | (2006.01) |
| *A63G 31/00* | (2006.01) |

(52) U.S. Cl.

CPC ..... *A63G 21/18* (2013.01); *A63G 31/12* (2013.01)

(58) Field of Classification Search

CPC ..... A63G 3/00; A63G 21/00; A63G 21/16; A63G 21/18; A63G 33/00; A63G 31/00; A63G 31/12; A63G 19/00; A63G 19/10

USPC ..... 472/116–117, 128; 405/79, 80, 87, 100, 405/104

See application file for complete search history.

(56) References Cited

U.S. PATENT DOCUMENTS

| | | | | |
|---|---|---|---|---|
| 2,982,547 | A | 5/1961 | Carrier | |
| 4,122,561 | A * | 10/1978 | Barr | E04H 4/105 4/499 |
| 5,154,671 | A | 10/1992 | Smollar et al. | |
| 5,401,214 | A | 3/1995 | Smollar et al. | |
| 6,062,983 | A | 5/2000 | Butsook | |
| 6,312,341 | B1 | 11/2001 | Healy | |
| 6,558,264 | B2 * | 5/2003 | Gordon | A63G 21/18 472/117 |
| 7,309,302 | B1 * | 12/2007 | Phillips | A63C 19/10 472/116 |
| 7,357,728 | B2 * | 4/2008 | Osler-Weppenaar | A63B 6/02 182/137 |
| 8,047,926 | B2 * | 11/2011 | Chen | A63G 31/12 472/134 |
| 2010/0285893 | A1 | 11/2010 | Leimone et al. | |

* cited by examiner

*Primary Examiner* — Kien Nguyen

(74) *Attorney, Agent, or Firm* — Uleses C. Henderson, Jr.; One LLP

(57) ABSTRACT

A water slide for connection to a water supply is provided. The inflatable structure may include a sliding surface having a first end and an opposing second end, an inflatable wedge-shaped ramp coupled to the first end of the sliding surface, where the ramp includes a top surface, and a landing portion coupled to the second end of the sliding surface. A water emitting device is coupled to the sliding surface, where the water emitting device is adapted to project water onto the ramp to lubricate the top surface while a user slides thereon.

17 Claims, 7 Drawing Sheets

WATER SLIDE

RELATED APPLICATIONS

This application claims priority of U.S. Application Ser. No. 62/024,124, filed on Jul. 14, 2014, titled WATER SLIDE, which application is incorporated in its entirety by reference in this application.

BACKGROUND INFORMATION

1. Field of Invention

The present disclosure relates to inflatable water toys and, in particular, to an inflatable water slide.

2. Background

Toy water slides have been a popular summertime activity for children for decades. Toy water slides generally comprise an elongated strip or sheet of plastic material that is secured to a ground area, and a sprinkler tube coupled along a side of the sliding surface to sprinkle water onto the sheet of plastic to lubricate it and create a wet and slippery sliding surface for the user. The user can then run towards the sheet of plastic and either slide or flop onto the sheet, where the inertia created by the run causes the user to slide or plane across the elongated sheet towards a terminal end of the sheet.

Water slides have been disclosed and marketed by many brands and recreational toy companies. However, there has been little innovation in the category and nothing has been done to soften the harsh landing at the beginning of the slide or to improve its performance, which is typically measured by children and parents as the ability and speed in which the user successfully traverses the length of the slide, the smoothness in which the user transitions from an upright crawl to an extended layout position on the sliding surface, and how "wet" the user becomes throughout the entire sliding experience. Finally, because most of the current art utilizes a planar or flat sliding surface, there is typically no cue or index to indicate to the user where they should start their sliding experience.

Current water slides in the art have several disadvantages. For instance, most users don't "take off" or transition from their upright crawl position onto the water slide until they reach the starting edge of the sliding surface and, as a result, do not use, for example, the first twelve to eighteen inches of the water slide. Therefore, their sliding experience is shortened.

In addition, most sprinkler systems used along the sides of the sliding surface to lubricate the slide are typically designed in such a way that the parabolic effect of water cascading from the sprinkler systems prevent the first two to three feet of the sliding surface from being properly wetted. To that end, even if the user times his or her "take off" such that their initial engagement with the water slide is perfectly at the start of the sliding surface, he/she would land on a relatively dry surface. Not to mention, such timing is hardly intuitive and can be likened to the intense training and discipline required of professional track and field athletes that take off perfectly at the edge of a long jump run-way. Landing on a hardened, dry sliding surface, as typically experienced with current water slides, is not only painful for the user, but the lack of lubrication often prevents the user from successfully traversing the length of the water slide.

Accordingly, a need therefore exists for a water slide that provides cushioning for the user during takeoff to minimize impact and injury as the user engages the water slide at the starting end, and provides lubrication along the entire length of water slide to maximize the velocity, speed, and momentum in which the user slides.

SUMMARY

A water slide for connection to a supply of water under pressure is provided. In one example, the water slide includes a sliding surface having a first end and an opposing second end, an inflatable wedge-shaped ramp—having a top surface—coupled to the first end of the sliding surface, a landing portion coupled to the second end of the sliding surface, and a water emitting device coupled to the sliding surface. The water emitting device is adapted to project water onto the ramp to lubricate the top surface while a user slides thereon.

The water slide further includes a sprinkler tube coupled to a side edge of the sliding surface, where the sprinkler tube defines a conduit for transporting water therethrough. The sprinkler tube is coupled to the supply of water to communicate water to the conduit. The sprinkler tube includes a plurality of spray holes in fluid communication with the conduit such that water pressure causes water to be ejected from the conduit through the spay holes onto the sliding surface.

The ramp includes a substantially U-shaped portion defining a trough for collecting run-off water from the top surface of the ramp. The trough maintains a pool of water at the first end of the sliding surface to provide a splash landing as the user transitions from the ramp to the sliding surface.

In some implementations, the water emitting device is coupled to an end of the sprinkler tube proximate the ramp. In such implementations, the water emitting device is in fluid communication with the conduit such that water pressure causes water to be ejected from the conduit through the water emitting device onto the top surface of the ramp. The water emitting device includes a plurality of apertures in fluid communication with the conduit. The plurality of apertures are arranged along a plane angularly offset from the plane of the sliding surface to project water onto the top surface of the ramp.

The landing portion includes a substantially U-shaped self-inflating bladder. The bladder includes a hollowed chamber and a plurality orifices in fluid communication with the chamber such that water pressure causes water to be ejected from the chamber through the orifices. The bladder defines a splash pool for accumulating water ejected from the orifices.

In some implementations, the sprinkler tube and the bladder are in fluid communication and serially connected such that water is communicated from sprinkler tube to the bladder to cause water to flow through the spray holes along the entire length of the sliding surface and through the orifices into the splash pool. In such implementations, the sprinkler tube and the bladder are connected by a feeder tube.

In alternative examples, the water slide may include a first sprinkler tube coupled to a first side edge of the sliding surface and a second sprinkler tube connected to an opposing side edge of the sliding surface. In such examples, each sprinkler tube defines a conduit for transporting water therethrough and each sprinkler tube is coupled to a water emitting device that projects water onto the top surface of the ramp. In such examples, the first sprinkler tube, the bladder, and the second sprinkler tube are in fluid communication and serially connected such that water is communicated from the first sprinkler tube to the bladder and from the bladder to the second sprinkler tube to cause water to flow through the spray holes along the entire length of the sliding surface and through the orifices into the splash pool.

An inflatable wedge-shaped structure for attachment to a water slide is also provided. The inflatable structure includes a bottom surface supported by a supporting surface, a top sliding surface spaced apart from the bottom surface where the top surface is downwardly sloped along which a user can slide from a top end to a bottom end thereof, a back wall coupled between the bottom surface and the top surface, and a U-shaped cut-out portion formed at an end oppose the back wall. The cut-out defines a trough for collecting water running off from the sliding surface.

The inflatable structure further includes a water source remotely located from the structure for projecting water onto the top end of the top surface, where the water flows from the top end down to the bottom end of the top surface to lubricate the top surface while a user slides thereon. The structure may further include a plurality of generally vertically disposed tensioning members that interconnect the bottom surface to the top surface to retain the inflatable structure in a wedge-shape. The tensioning members form a plurality of interconnected vertically disposed chambers that are fillable through an air valve affixed to the structure. The tensioning members further define a plurality of billows extending longitudinally along the top surface for funneling water from the top end of the top surface to the bottom end of the top surface. The tensioning members may be constructed from a solid sheet of material or a sheet of porous material.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Figure 1:
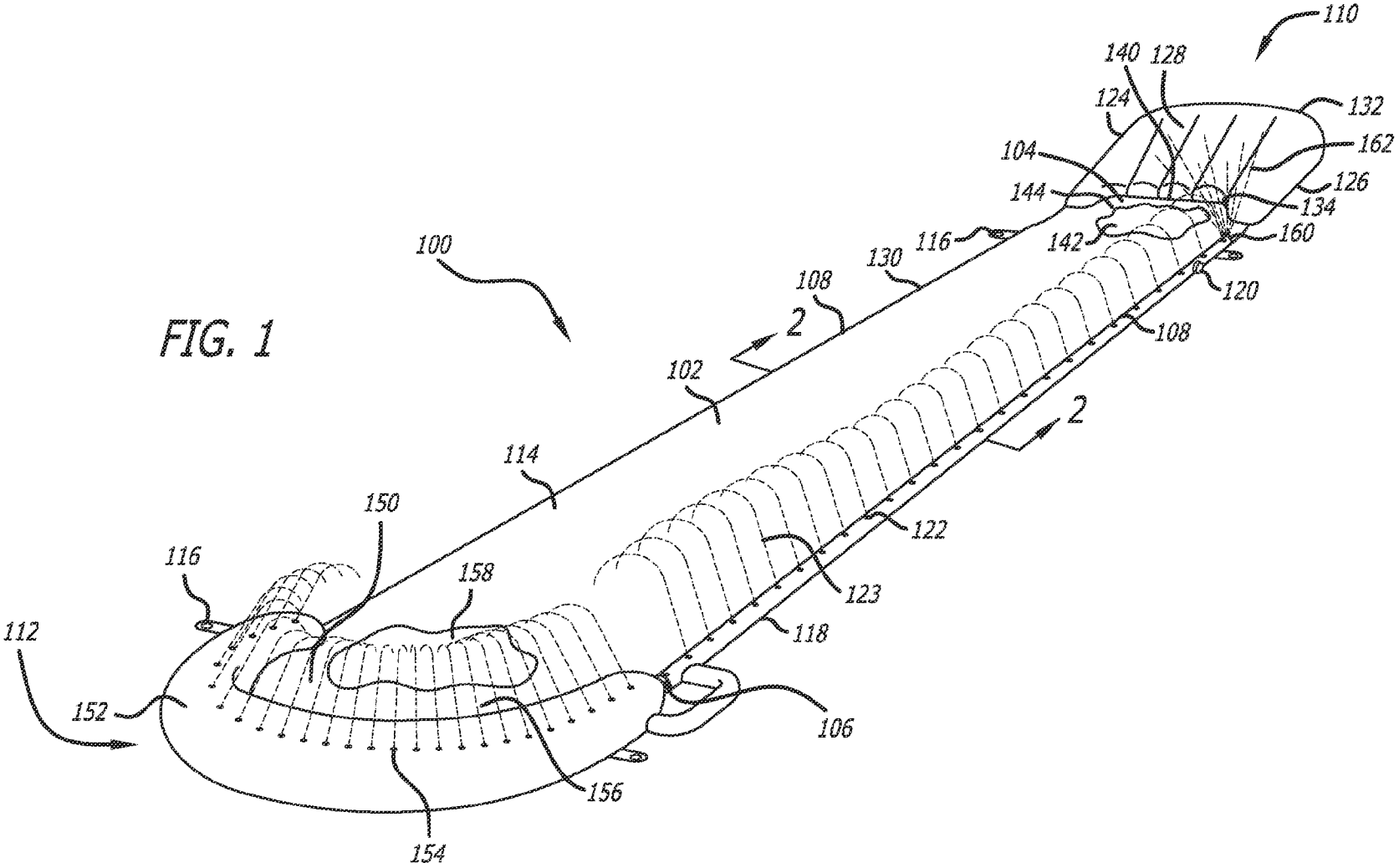
FIG. 1 is a front perspective view of one example of a water slide in accordance with the teachings of the present disclosure.

FIGS. 1-10 illustrate examples of various implementations of a water slide in accordance with the teachings of the present disclosure. In particular, FIG. 1 is a perspective view of one example of a water slide 100 according to an implementation of the present disclosure. As shown, the water slide 100 includes an elongated sliding surface 102 having a first or starting end 104, an opposite or terminal end 106, and opposing side edges 108. The water slide 100 further includes a wedge-shaped launch ramp 110 coupled to the starting end 104, and a landing portion 112 coupled to the terminal end 106. The launch ramp 110 provides a cushioning surface for the user as the user transitions from a standing or running, semi-crouched position to, for example, a head-first sliding position at the starting end 104 of the sliding surface 102. The launch ramp 110 is configured such that a first pool of water is formed in a region defined between the launch ramp 110 and the starting end 104 of the sliding surface 102 to provide a "splash landing" as the user transitions from the launch ramp 110 to the sliding surface 102. The landing portion 112 is configured such that a second pool of water is formed in a region defined between the terminal end 106 of the sliding surface 102 and the landing portion 112 to provide a "splash pool" as the user reaches the end of the sliding surface 102, thus enhancing the user's sliding experience.

The launch ramp 110 and landing portion 112 may be coupled to the sliding surface 102 by radio-frequency (RF) or ultrasound welding, hot-air coupling (e.g., heat sealing, melting or welding), adhering (e.g., gluing) or other bonding methods known in the art. The sliding surface 102, launch ramp 110, and landing portion 112 may be constructed of plastic, polyvinyl chloride (PVC), thermoplastic rubber (TPR), polyethylene vinyl acetate (PEVA), ethylene vinyl acetate (EVA), thermoplastic polyurethane elastomer (TPU), neoprene-coated fabric, or any other suitable material.

Turning now to the slide portion, the sliding surface 102 includes a sliding sheet 114 made from PVC sheeting or any other low-friction, wear-resistant material. The sliding sheet 114 may be pliable to enable the sheet to conform to the shape of the ground or support surface onto which it is placed. The sliding sheet 114 may further include one or more anchor straps 116 with grommets for securing the sliding sheet 114 to the ground, via driving posts or stakes (not shown), during use.

In some implementations, the sliding surface 102 may include a single sliding sheet 114. In other implementations, the sliding surface 102 may include two or more sliding sheets 114 coupled together to provide a wider sliding surface 102 to accommodate more than one user at a time.

Water may be sprayed along the length of the sliding surface 102 by a sprinkler tube 118 coupled to the sliding surface 102. The elongated sprinkler tube 118 may be integrally formed with (i.e., formed from a single sheet of plastic) or welded, bonded (i.e., separately formed and joined together in a permanent configuration) or otherwise coupled to one or both side edges 108 of the sliding surface 102. It may be preferred to couple a sprinkler tube 118 to both side edges 108 of the sliding surface 102 in implementations where the sliding surface 102 consists of multiple lanes for accommodate more than one user at a time. The sprinkler tube 118 is a hollow tube made from PVC sheeting or any other durable material.

Figure 2:
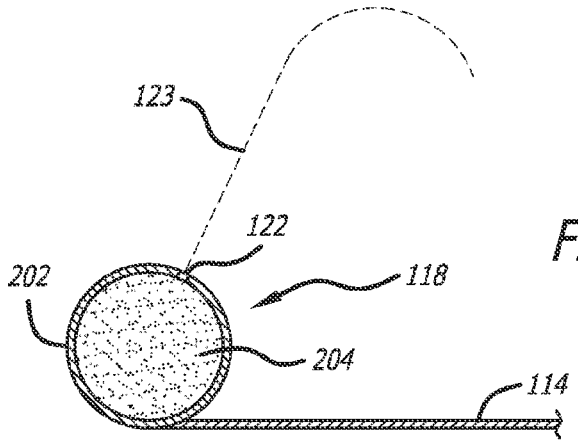
FIG. 2 is a cross-sectional view of the sliding surface taken along line 2-2 of the water slide illustrated in FIG. 1.

As shown in FIG. 2, the sprinkler tube 118 includes a tubular wall 202 that defines a conduit 204 for transporting water along at least one side edge 108 of the sliding sheet 114. The conduit 204 is in fluid communication with spray holes 122 such that the flow of water transported within the conduit and water pressure cause water to be ejected through the spay holes 122, onto the sliding surface 102. The sprinkler tube 118 is configured to spray water along the entire length of the sliding surface 102 when coupled to a pressurized water supply.

Referring now back to FIG. 1, the sprinkler tube 118 includes a hose adapter 120 for connecting the sprinkler tube 118 to a standard water hose (not shown) or the like. The hose adapter is in fluid communication with conduit 204 (i.e., fluid from the hose adapter 120 shall flow into the sprinkler tube 118 without encountering a blockage that would prevent such flow). The hose adapter 120 functions as a situs for the admission of water into the sprinkler tube 118 and landing portion 112, as will be described in greater detail below.

The sprinkler tube 118 includes a plurality of spaced spray holes 122 extending along an outer periphery of the sprinkler tube 118. The spray holes 122 communicate with the conduit 204 of the sprinkler tube 118 to allow the egress of water from within the conduit 204 through the spray holes 122 to provide a spray or stream of water 123 directed onto the sliding sheet 114 to lubricate the sheet. These spray holes 122 may be spaced close to each other and comprise relatively small orifices. The spray holes 122 are preferably sized such that water pressure is maintained within the conduit 204 while, at the same time, permitting a sufficient amount of water to escape from the sprinkler tube 118 to lubricate the sliding surface 102. In some implementations, the spray holes 122 may be, for example, between about 0.1 mm and about 0.7 mm in diameter; and may be spaced, for example, between about every 1 inch to about every 10 inches. As an example, which is not meant to limit the scope of the present disclosure, for a sliding sheet 114 having dimensions approximately 136 inches long and 34 inches wide, the spray holes 122 may be approximately 0.5 mm in diameter and spaced every 5 inches apart. It will be understood that, in any implementation, the size and spacing of spray holes 122 may be non-uniform and irregular, as well.

The spray holes 122 may also be directed or angled inwardly to project the spray of water 123 in a parabolic fashion toward the center of the sliding surface 102. It can be appreciated that, when a water hose is connected to the hose adapter 120 and water is turned on, the water sprays out of the spray holes 122, which act as jets spraying water across an upper surface of the sliding sheet 114 as shown in FIG. 1. Thus, when water slide 100 is placed on a flat surface, water flows generally from the hose adapter 120, through the spray holes 122, onto sliding sheet 114, and off the water slide at lateral edge 108.

Referring now to the starting end 104, the launch ramp 110 includes a substantially U-shaped inflatable body 124 having a bottom surface or base 126 supported by the ground and an inclined or downwardly sloped top surface 128. The bottom surface 126 and the top surface 128 are are interconnected by a substantially rounded front wall 402 (FIG. 4), a substantially rounded back wall 132, and a pair of side walls 134. In some implementations, the launch ramp 110 may be constructed to dimensions of, for example, 48 inches in length, 34 inches in width, and 16 inches in height, or any other suitable dimensions.

The U-shaped inflatable body 124 configuration forms a cut-out 140 that, in turn, defines a trough 142 for collecting run-off water from the top surface 128, as will be discussed in further detail below. The trough 142 maintains a pool of water at a transition region 144 between the launch ramp 110 and the sliding surface 102. This pool of water provides a splash landing as the user transitions from the launch ramp 110 to the sliding surface 102. This enables the entire length of the sliding surface 102 to be lubricated or "wetted," thus providing more enjoyment and improved slipperiness for the user.

According to the present disclosure, it is intended that as the user transitions from running to sliding, the user will engage the ramp 110 prior to engaging the sliding surface 102. Thus, the ramp 110 provides a surface at the beginning of the water slide that cushions the landing of the user and "launches" or propels the user onto the sliding surface 102. When fully inflated, the launch ramp 110 provides very high bounce characteristics for propelling the user forward from the ramp along the sliding surface 102.

Referring now to the terminal end 106 of the sliding surface, the landing portion 112 may include base sheet 150 and a fluid-inflatable U-shaped bumper 152. The base sheet 150 includes a sheet of material corresponding in width to the sliding surface 102. The base sheet 150 may be constructed of plastic, PVC, TPR, PEVA, EVA, TPU, neoprene-coated fabric, or any other suitable material. In most implementations, the base sheet 150 is preferred made from the same material as the sliding surface 102. The base sheet 150 may be coupled to the sliding surface 102 by RF or ultrasound welding, hot-air coupling, adhering or other bonding methods known in the art.

The inflatable bumper 152 includes a hollowed fluid chamber (not shown) and a plurality of spaced orifices 154, extending along an upper surface of the bumper 152, that communicate with the hollowed fluid chamber. Several methods for forming a hollowed fluid chamber and attaching it to the base sheet 150 are well known. In one implementation, the base sheet 150 and the bumper 152 are formed from a single sheet of material. In another implementation, the base sheet 150 and bumper 152 are separately formed and joined together in a permanent configuration (such as by bonding or welding) or include coupling mechanisms (such as hook and loop fasteners) to adhere the bumper 152 to the base sheet 150. In some implementations, the inflatable bumper 152 may have footprint dimensions of, for example, 32 inches in length and 34 inches in width, or any other suitable dimensions.

The orifices 154 may be even spaced apart and of relatively small dimensions. In some implementations, the orifices 154 may be, for example, between about 0.1 mm and about 0.7 mm in diameter and may be spaced, for example, between about every 1 inch to about every 5 inches and, more preferably, about every 2.5 inches apart. The orifices 154 may be arranged along the upper surface of the bumper 152 such that they are angled inwardly toward the central longitudinal axis of the base sheet 150. In most implementations, the hose adapter 120, sprinkler tube 118, and bumper 152 are in fluid communication and serially connected. It can be appreciated that, when the hose adapter 120 is connected to a supply of water under pressure (e.g. a water hose) and the water is turned on, water is communicated from the sprinkler tube 118 to the bumper 152 and the resulting flow and water pressure will then cause water to spray out of the orifices 145, which act as jets spraying water across the base sheet 150 of the landing portion 112. The bumper 152 is thus "self-filling" in that it inflates with water when the water slide 100 is in use.

The U-shaped bumper 152 defines a well 156 therein. The well 156 defines a splash pool 158 for accumulating water sprayed from the orifices 154 into the well 156. The bumper 152 functions as a stop to catch the user as the user slides beyond the terminal end 106 of the sliding surface 102. The splash pool 158 collects a pool of water to provide a final splash landing for the user as the user traverses towards the bumper 152. The bumper 152 may be inflated with air, water or other fluid.

Figure 3:
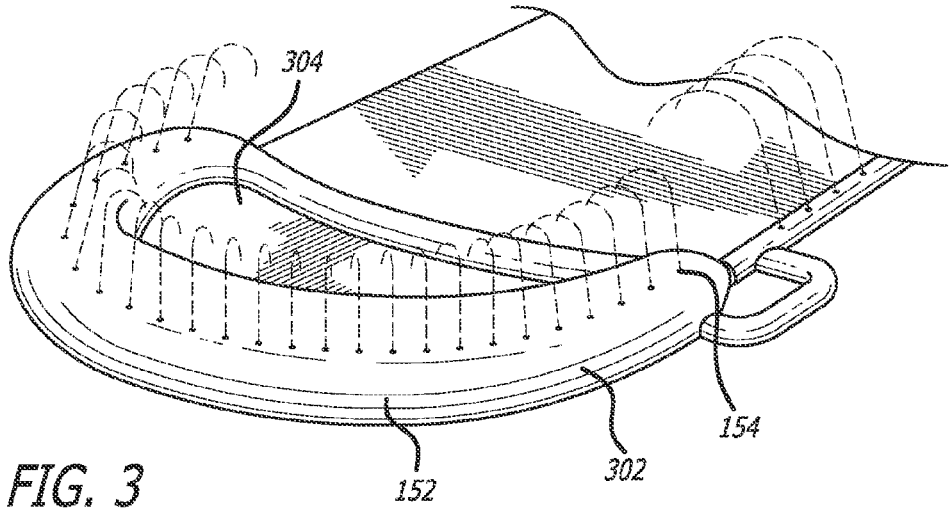
FIG. 3 is a partial rear perspective view illustrating features of the landing portion of an alternative example of a water slide in accordance with the teachings of the present disclosure.

In other implementations, the bumper 152 may form an enclosed, substantially D-shaped inflatable structure 302, as shown in FIG. 3. In this implementation, the enclosed structure 302 defines a shallow pool 304 for accumulating water ejected from the bumper orifices 154.

In some implementations, the bumper 152 may include additional water plugs or drain valves (not shown) on its underside for releasing water from the fluid chamber. When in use, the water slide 100 can be very heavy because of the cumulative weight of the water passing through the various sections of the slide. The plugs and/or valves enable water to be expelled from the bumper at a fairly rapid rate to drain or lighten the weight of the slide, as the user may desire to transport the water slide 100 from one location to another, for example across a lawn, without having to fully collapse or disassemble the waterslide. Without a drain valve, it could take the bumper 152 some time to drain.

Referring back to FIG. 1 and returning to the starting end 104 of the sliding surface 102, the sprinkler tube 118 may include a water emitting device 160 adapted to project water 162, in a parabolic fashion, from the sprinkler tube 118 onto the top surface 128 of the launch ramp 110. In this way, the top surface 128 of the launch ramp 110 is lubricated or "wetted" by the water emitting device 160, which improves the degree of slickness or hydroplaning performance of the sliding surface 102 to enhance the user's sliding experience. The water 162 projected onto the top surface 128 of the launch ramp 110 is then funneled to the trough 142 via billows formed in the top surface 128 of the ramp.

Figure 4:
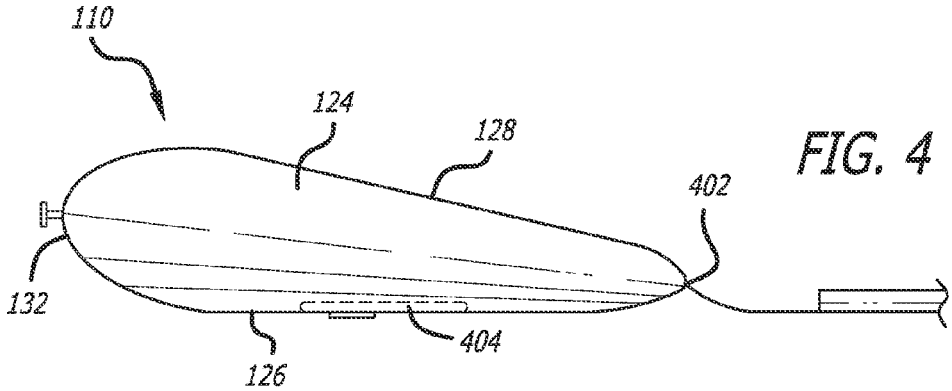
FIG. 4 is a partial side view of the water slide of FIG. 1 illustrating features of the launch ramp.

FIG. 4 is a side view of the launch ramp 110. As shown, the top surface 128 is inclined from the base 126 such that the inflatable body 124 forms a substantially triangular or wedge-shaped structure. It is further shown that the back wall 132 is substantially rounded. In some implementations, the inflatable body 124 may include one or more water finable pockets 402 (shown in hidden lines) along each lateral side of the body 124, near the base 126 for anchoring the launch ramp 110 to the ground without the need of stakes, which may cause injury to the user. In the alternative, the launch ramp 110 may include one or more anchor straps for securing the launch ramp 110 to the ground, via driving posts or stakes (not shown), during use.

Figure 5:
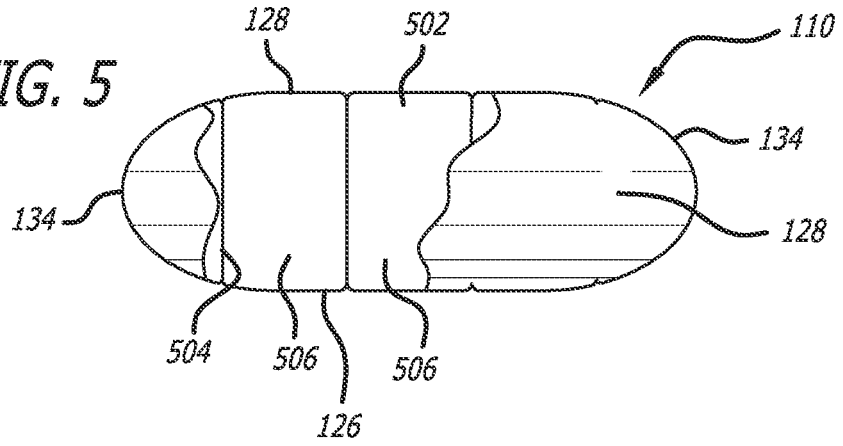
FIG. 5 is a partial cut-out front view of the water slide of FIG. 1 illustrating the interior features of the launch ramp.

FIG. 5 is a partial cut-out rear view of the water slide 100, illustrating the interior of the launch ramp 110. As shown, the body 124 of the launch ramp 110 is an inflatable bladder that includes an air-fillable interior 502 and one or more tensioning members 504 extending therethrough that interconnect the bottom surface 126 to the top surface 128 of inflatable body 124. Each tensioning structure 504 may include, for example, a baffle or I-beam panel made of a tensile sheet of solid or porous material (e.g., a cast screen or open mesh fabric). Each tensioning structure 504 may be constructed of cloth, nylon, polyester, plastic, PVC, TPR, PEVA, EVA, TPU, neoprene-coated fabric, or any other durable material. The tensioning members 504 give shape to the launch ramp 110 and prevent the structure from over-expanding or "ballooning" (i.e., from bubbling or expanding on all sides similar to that of a balloon) when the structure is filled with air. These type of tensioning members are well known to those skilled in the art of inflatable devices. The tensioning members 504 are preferably lightweight and occupy minimal volume when the inflatable body 124 is deflated and packed away, while also functioning as strong and durable internal supports upon inflation and use of the ramp. While the tensioning structure 504 is shown in FIG. 5 as an I-beam structure, other tensioning structure 504 may be used in accordance with the present disclosure, including tufted beam structures, coil-beam structures, X-beam structures, and the like.

The tensioning members 504, collectively, form channels 506 that help shape and structurally reinforce the inflatable body 124. In implementations where the tensioning members 504 are made of porous material, air is communicated between the channels 506 through the panels. In implementations where the tensioning members 504 are made of solid material, the panels may be constructed to permit air to communicate around the edges of the tensioning members 506.

Figure 6:
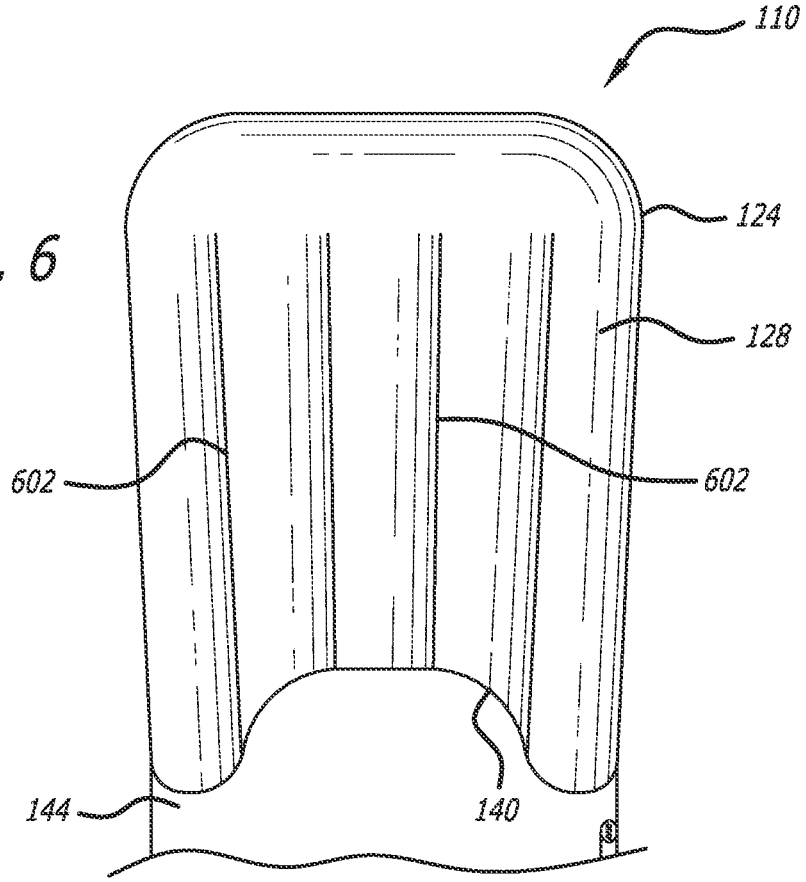
FIG. 6 is a top plan view of the launch ramp illustrated in FIG. 4.

FIG. 6 is a partial top view of water slide 110 showing features of the launch ramp 110. As shown, the tensioning members 504 (not shown) form a series of waves or billows 602 that extend along the length of the launch ramp 110 for enhancing the durability of the inflatable body 124 and funneling water projected onto the top surface 128 to the trough 142 at the base 126 of the ramp 110. As further show, the transition region 144 includes a planar sheet of plastic or other suitable material that is coupled between the front wall 402 of the launch ramp 110 and the starting end 104 of the sliding surface 102. The planar sheet may be coupled to the front wall 402 and the sliding surface 102 by heat sealing, welding, bonding and the like.

Figure 7:
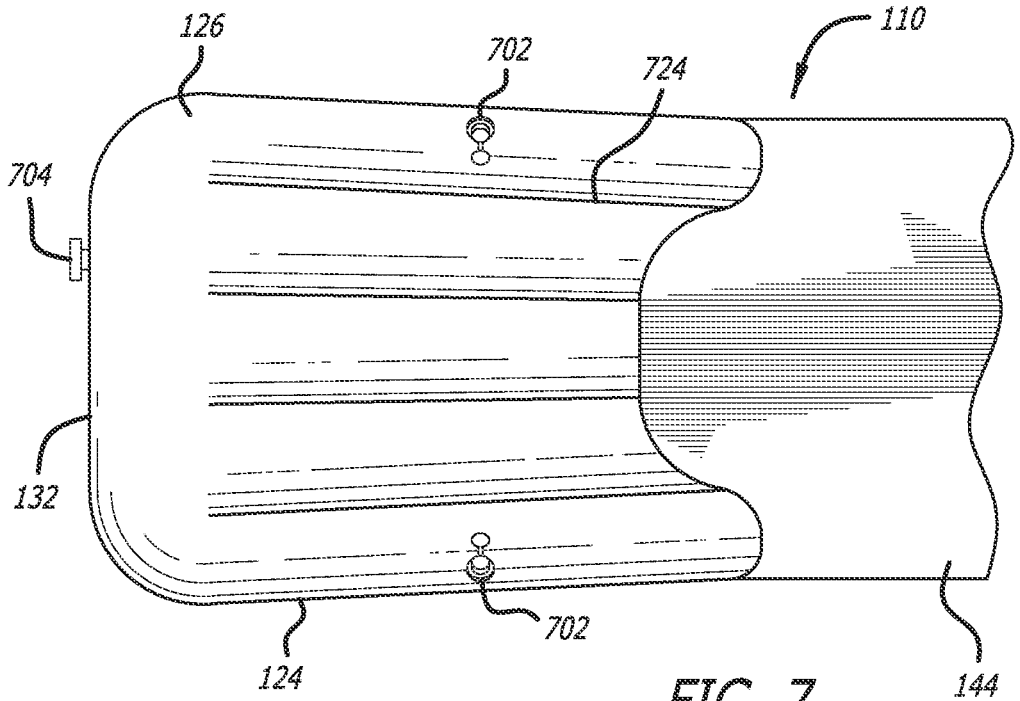
FIG. 7 is a bottom plan view of the launch ramp illustrated in FIG. 4.

FIG. 7 is a partial bottom view of water slide 110 showing additional features of the launch ramp 110. As shown, the bottom surface 126 may include one or more water valves 702 for feeding water into to the water pockets 402 previously discussed in FIG. 4. The water valves 402 may be connected to a standard water hose or the like. As further shown, the back wall 132 may include an air valve or plug 404 for inflating and deflating the inflatable body 124.

Figure 8:
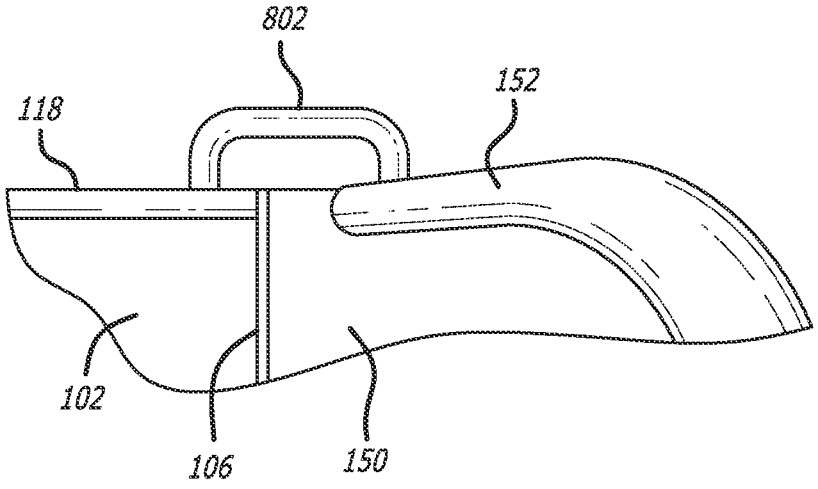
FIG. 8 is a partial top plan view of the terminal end of the water slide illustrated in FIG. 1.

FIG. 8 is an enlarged partial view of the terminal end 106 of the sliding surface 102. As shown, a feeder tube 802 is coupled between the sprinkler tube 118 and the bumper 152 to pass water from the sprinkler tube 118 to the bumper 152 to automatically inflate the bumper with water 152 when sprinkler tube 118 is connected to a garden hose. The feeder tube 802 may be heat sealed or otherwise bonded to the sprinkler tube 118 and bumper 152. The feeder tube is preferably made from the same material as the sprinkler tube 118 and bumper 152.

Figure 9A:
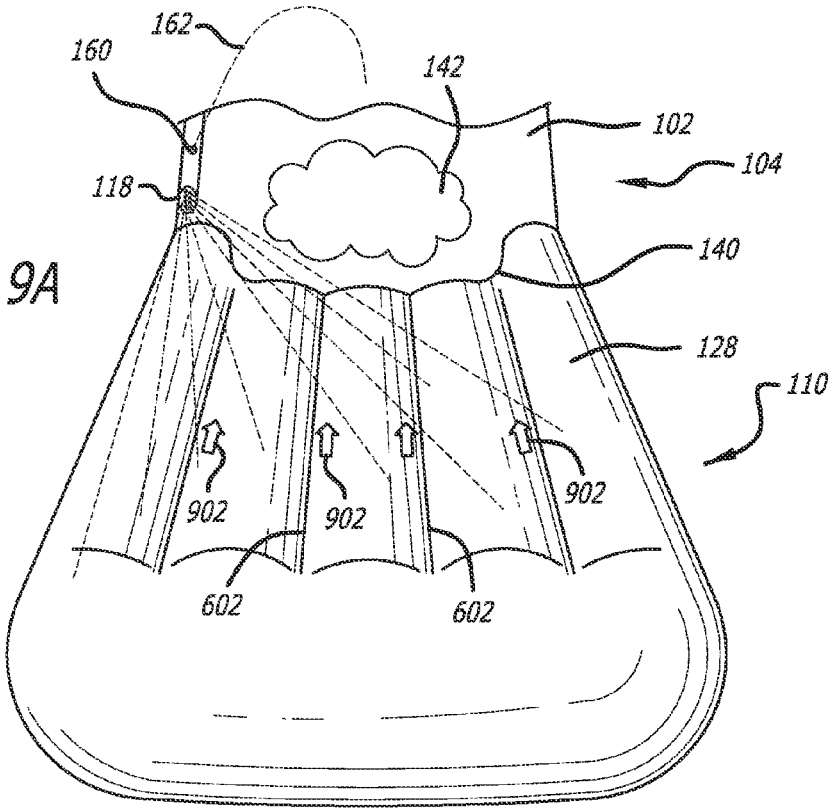
FIG. 9A is a partial front perspective view illustrating features of the starting end of the water slide of FIG. 1.

FIG. 9A is an enlarged perspective view of the starting end 104 of the sliding surface 102. In particular, this figure illustrates how water 162 is projected from the water emitting device 160 onto the top surface 128 of the launch ramp 110 and funneled down the billows 602, as depicted by arrows 902, to the trough 142.

Figure 9B:
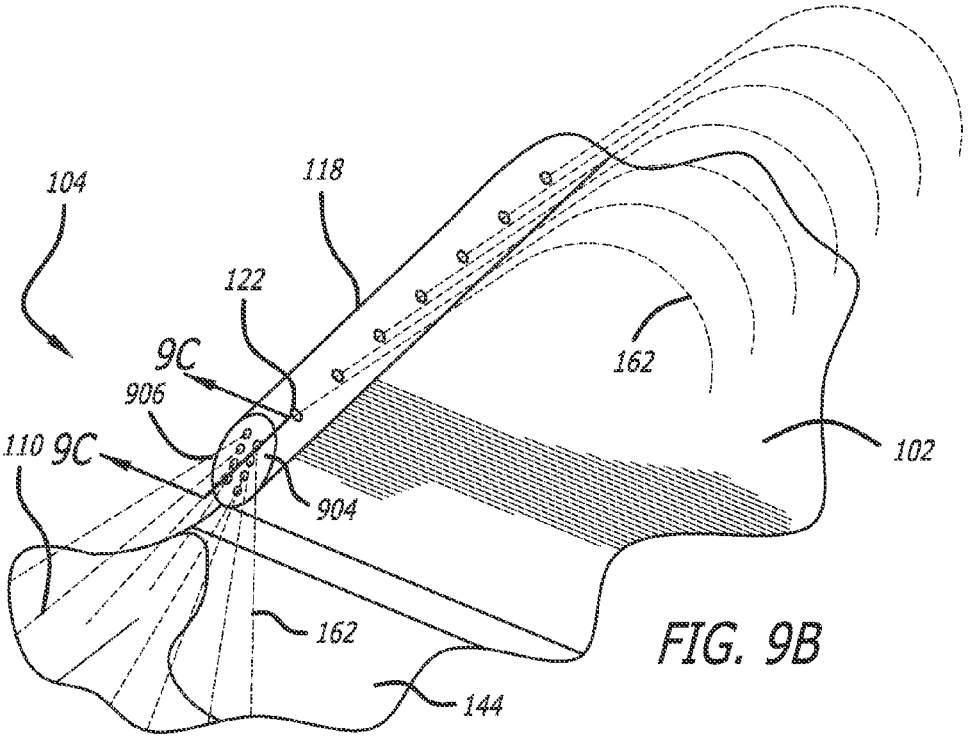
FIG. 9B is partial perspective view illustrating features of the water emitting device of the water slide of FIG. 1.

FIG. 9B is an enlarged partial plan view of the starting end 104 of the sliding sheet 102. As shown, the water emitting device 160 is coupled to a proximal end 904 of the sprinkler tube 118 for projecting water from the sprinkler tube 118 onto the top surface 128 of the launch ramp 110. The water emitting device 160 includes a series of apertures 906 or water jets adapted to project water 162 (FIG. 1), in a parabolic fashion, from the sprinkler tube 118 onto the top surface 128. Thus, the top surface 128 of the launch ramp 110 is lubricated or "wetted" by the water emitting device 160. The water 162 projected onto the top surface 128 of the launch ramp 110 is then funneled to the trough 142 (FIG. 1) via the billows 602 (FIG. 6).

As shown, the apertures 906 may be arranged in a staggered row and column array. However, in other implementations, the aperture 906 may be arranged in a circular array, triangular array, or any other suitable configuration.

Figure 9C:
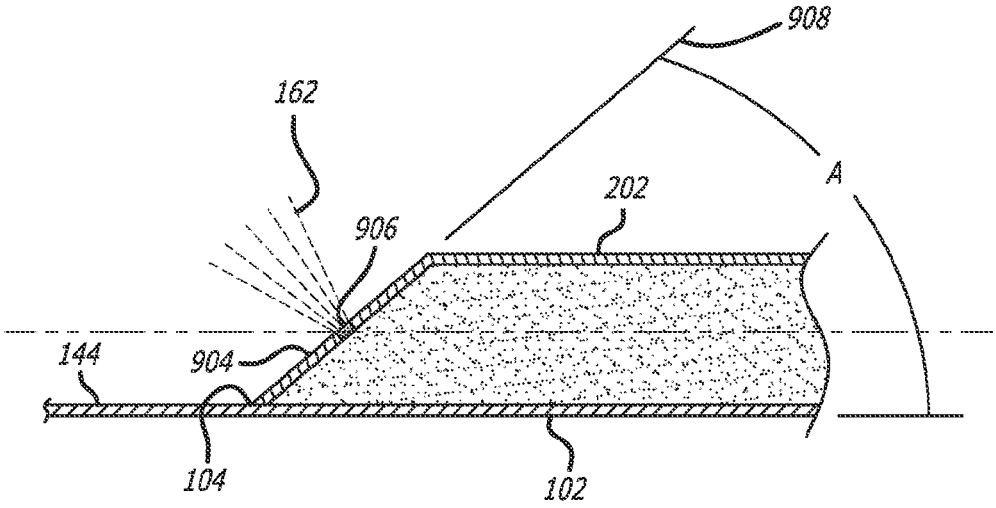
FIG. 9C is a partial cross-sectional view of the proximal end of the sprinkler tube taken along line 9C-9C of the portion of the water slide illustrated in FIG. 9B.

FIG. 9C is a partial cross-sectional view of the proximal end 904 of the sprinkler tube 118. As shown, when the sprinkler tube 118 is self-inflated with water, the proximal end 904 of the sprinkler tube 118 is configured such that it is inclined along a plane 908 that is angularly offset from the planar surface of the sliding surface 102, as depicted by angle A.

The spacing and diameter of the apertures 906 and their angular offset relative to the planar surface of the sliding sheet 114 may be varied to adjust the projection of the water 162 (i.e., the water angle and distance) onto the top surface 128 of the launch ramp 110. For example, in some implementations the apertures 906 may be between about 0.1 mm and about 0.7 mm in diameter and spaced apart by, for example, between about every 3 mm and 15 mm. Further, the apertures 906 may be angled (as shown by angle A), for example, between about 10° and about 60° relative to the planar surface of the sliding sheet 114. While the water emitting device 160 has been illustrated and described herein as being integral with the sprinkler tube 118, in other implementations, the water emitting device 160 may be a separate component coupled to the sprinkler tube 118 or a separate water supply source.

In some implementations, the water slide 100 may be 216 inches in length, by 34 inches in width. However, the dimensions of the water slide 100 and its various components may vary depending on its intended application.

Figure 10:
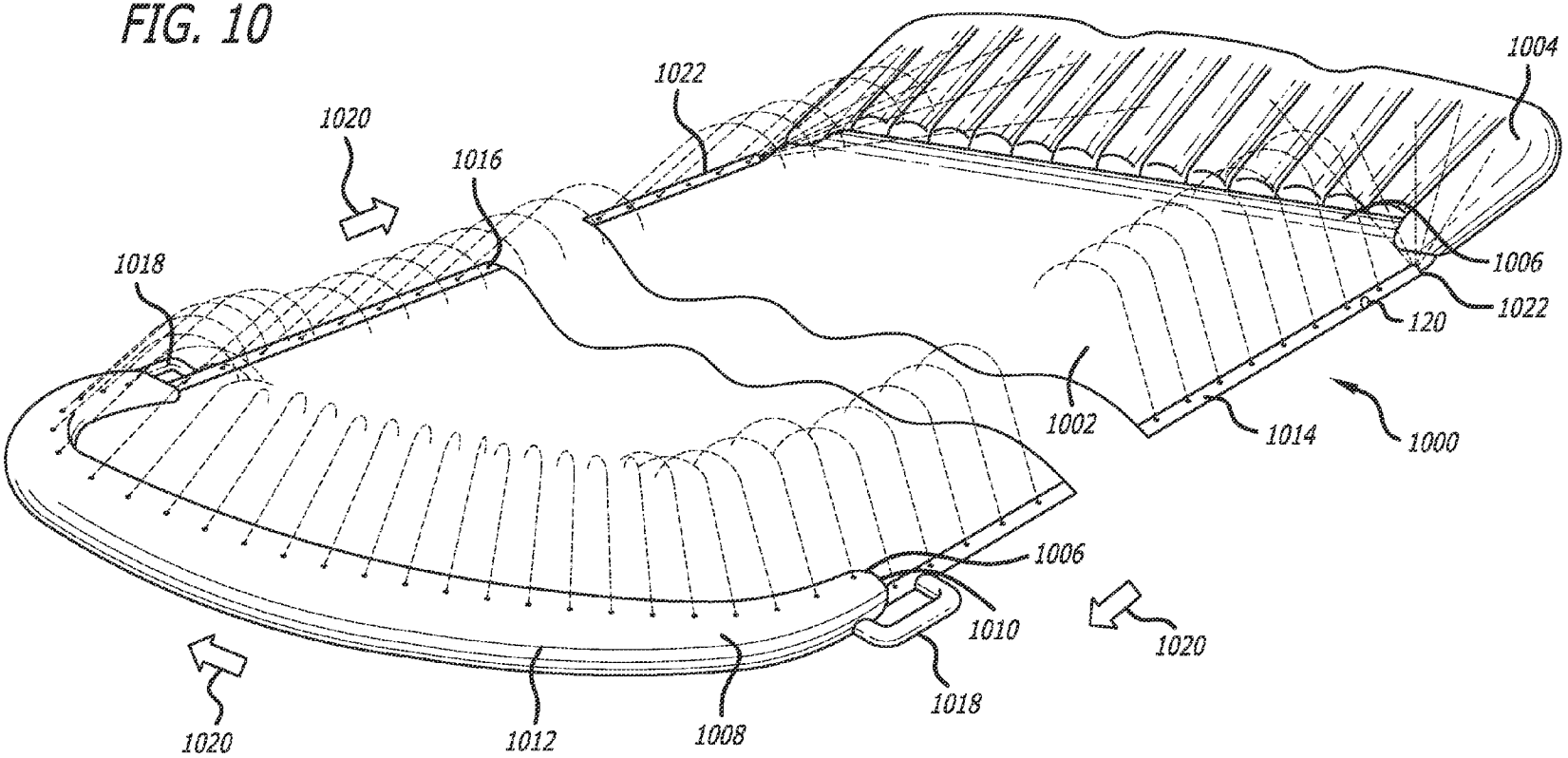
FIG. 10 is a rear perspective view of a second example of a water slide in accordance with the teachings of the present disclosure.

For example, FIG. 10 is a perspective view of a second example of a water slide 1000 according to an implementation of the present disclosure. The water slide 1000 shown in FIG. 10 is adapted to accommodate two or more users at the same time.

As shown, the water slide 1000 includes an elongated sliding surface 1002 with a wedge-shaped launch ramp 1004 coupled to a starting end 1006 of the sliding surface 1002, and a landing portion 1008 coupled to a terminal end 1010 of the sliding surface 1002. The landing portion 1008 includes a water inflatable bumper 1012.

In this example, the water slide 1000 includes sprinkler tubes 1014, 1016 coupled to both side edges of the sliding surface 1002 to lubricate the surface, and a pair of feeder tubes 1018 coupled between the sprinkler tubes 1014, 1016 and the inflatable bumper 1012. In this way, the sprinkler tube 1014, bumper 1012, and sprinkler tube 1016 are in fluid communication and serially connected. Thus, for example and without limitation, when sprinkler tube 1014 is connected to a supply of water under pressure, water will flow in the direction indicated by arrow 1020 along sprinkler tube 1014, inflatable bumper 1012, and sprinkler tube 1016. In implementations where the surface area of the waterslide has been increased to accommodate multiple users simultaneously, such as waterslide 1000 illustrated in FIG. 10, a water emitting device 1022 may be coupled to proximal ends of both sprinkler tubes 1014, 1016 to lubricate the entire top surface of the launch ramp 1004.

Water slides of the present disclosure provide the several advantages over existing water slides. For instance, water slides of the present disclosure improve cushioning for the user during takeoff to minimize impact and injury as the user engages the water slide at the starting end. Water slides of the present disclosure provide lubrication along the entire length of water slide to maximize the velocity, speed, and momentum in which the user slides, and create a pool of water and splash when the user slides, thus enhancing the entertainment value and improving the slickness/slipperiness of the water slide.

In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

Although the previous description illustrates particular examples of various implementations, the present disclosure is not limited to the foregoing illustrative examples. A person skilled in the art is aware that the disclosure as defined by the appended claims and their equivalents can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. A water slide for connection to a supply of water under pressure, the water slide comprising:

a substantially planar sliding surface, the sliding surface having a first end and an opposing second end;

an inflatable wedge-shaped ramp coupled to the first end of the sliding surface, the ramp having a top surface;

a landing portion coupled to the second end of the sliding surface; and a water emitting device coupled to the sliding surface, the water emitting device being spaced apart from and positioned downstream of the ramp, the water emitting device being adapted to project water onto the ramp to lubricate the top surface while a user slides thereon.

2. The water slide of claim 1 further comprising a sprinkler tube coupled to a side edge of the sliding surface, the sprinkler tube defining a conduit for transporting water therethrough, the sprinkler tube being coupled to the supply of water to communicate water to the conduit.

3. The water slide of claim 2, wherein the sprinkler tube includes a plurality of spray holes in fluid communication with the conduit such that water pressure causes water to be ejected from the conduit through the spay holes onto the sliding surface.

4. The water slide of claim 2, wherein the water emitting device is coupled to an end of the sprinkler tube proximate the ramp, the water emitting device being in fluid communication with the conduit such that water pressure causes water to be ejected from the conduit through the water emitting device onto the top surface of the ramp.

5. The water slide of claim 4, wherein the water emitting device includes a plurality of apertures in fluid communication with the conduit, the plurality of apertures being arranged along a plane angularly offset from the plane of the sliding surface to project water onto the top surface of the ramp.

6. The water slide of claim 2, wherein the landing portion includes a substantially U-shaped self-inflating bladder, the bladder including a hollowed chamber and a plurality orifices in fluid communication with the chamber such that water pressure causes water to be ejected from the chamber through the orifices, the bladder defining a splash pool for accumulating water ejected from the orifices.

7. The water slide of claim 6, wherein the sprinkler tube and the bladder are in fluid communication and serially connected such that water is communicated from sprinkler tube to the bladder to cause water to flow through the spray holes along the entire length of the sliding surface and through the orifices into the splash pool.

8. The water slide of claim 7, wherein the sprinkler tube and the bladder are connected by a feeder tube.

9. The water slide of claim 1, wherein the ramp includes a substantially U-shaped portion defining a trough for collecting run-off water from the top surface of the ramp, the trough maintaining a pool of water at the first end of the sliding surface to provide a splash landing as the user transitions from the ramp to the sliding surface.

10. The water slide of claim 1 further comprising a first sprinkler tube coupled to a first side edge of the sliding surface and a second sprinkler tube connected to an opposing side edge of the sliding surface, each sprinkler tube defining a conduit for transporting water therethrough, each sprinkler tube being coupled to a water emitting device that projects water onto the top surface of the ramp.

11. The water slide of claim 10, wherein the first sprinkler tube, the bladder, and the second sprinkler tube are in fluid communication and serially connected such that water is communicated from the first sprinkler tube to the bladder and from the bladder to the second sprinkler tube to cause water to flow through the spray holes along the entire length of the sliding surface and through the orifices into the splash pool.

12. An inflatable wedge-shaped structure for attachment to a water slide, the structure comprising:

a bottom surface supported by a supporting surface;

a top surface spaced apart from the bottom surface, the top surface being downwardly sloped along which a user can slide from a top end to a bottom end thereof;

a back wall, the back wall being coupled between the bottom surface and the top surface;

a U-shaped cut-out portion formed at an end oppose the back wall, the cut-out defining a trough for collecting water-runoff from the top surface; and a water source remote from and positioned downstream of the inflatable structure for projecting water onto the top end of the top surface, wherein the water flows from the top end down to the bottom end of the top surface to lubricate the top surface while a user slides thereon.

13. The inflatable wedge-shaped structure of claim 12 further comprising a plurality of generally vertically disposed tensioning members that interconnect the bottom surface to the top surface to retain the inflatable structure in a wedge-shape.

14. The inflatable wedge-shaped structure of claim 13, wherein the tensioning members form a plurality of interconnected vertically disposed chambers that are fillable through an air valve affixed to the structure.

15. The inflatable wedge-shaped structure of claim 13, wherein the tensioning members define a plurality of billows extending longitudinally along the top surface for funneling water from the top end of the top surface to the bottom end of the top surface.

16. The inflatable wedge-shaped structure of claim 13, wherein tensioning members comprise a solid sheet of material.

17. The inflatable wedge-shaped structure of claim 13, wherein the tensioning members comprise a sheet of porous material.

* * * * *